United States Patent [19]

Egbers et al.

[11] 4,011,712

[45] Mar. 15, 1977

[54] THREAD DRAWOFF TUBE FOR OPEN-END SPINNING MACHINES

[75] Inventors: Gerhard Egbers, Eningen; Peter Artzt, Reutlingen, both of Germany

[73] Assignee: Schubert & Salzer Maschinenfabrik Aktiengesellschaft, Ingolstadt, Germany

[22] Filed: Sept. 5, 1975

[21] Appl. No.: 610,662

[30] Foreign Application Priority Data

Sept. 21, 1974 Germany ..... 2445206

[52] U.S. Cl. ..... 57/58.89

[51] Int. Cl.[2] ..... D01H 1/12

[58] Field of Search ..... 57/58.89–58.95

[56] References Cited

UNITED STATES PATENTS

| | | | |
|---|---|---|---|
| 3,640,061 | 2/1972 | Landwehrkamp | 57/58.89 |
| 3,834,147 | 9/1974 | Havranek et al. | 57/58.89 |

*Primary Examiner*—Richard C. Queisser
*Assistant Examiner*—Charles Gorenstein
*Attorney, Agent, or Firm*—Robert W. Beach; R. M. Van Winkle

[57] ABSTRACT

Transmission of the thread twist-forming force to the thread end is facilitated by a finger mounted eccentrically in the bore of the thread drawoff tube. The thread, which is rotated about the circumference of the bore, periodically engages the finger, which finger plucks the thread away from the tube wall and momentarily relieves the bearing force between the thread and the drawoff tube at the tube infeed end. The finger is spaced inwardly from the tube infeed end and may be a pin projecting radially inward from the tube wall or an offset wire extending parallel to but eccentrically of the tube axis.

4 Claims, 2 Drawing Figures

THREAD DRAWOFF TUBE FOR OPEN-END SPINNING MACHINES

BACKGROUND OF THE INVENTION

1. Field of the Invention

The present invention relates to drawoff tubes for open-end spinning machines.

2. The Problem

Conventionally in open-end spinning machines the thread being spun is clamped against rotation about its axis by the nip of drawoff rollers. The thread portion between the spinning rotor and the drawoff rollers is twisted by the thread being bent at the infeed end of the drawoff tube so that the bent portion bears against the tube mouth and the thread is turned so that it is rolled around the circumference of the tube mouth. A portion of the thread extending between the tube mouth and the binding point of the fiber collection surface of the spinning rotor acts like a crank which effects the circumferential travel of the thread around the drawoff tube mouth. In prior apparatus, the rotor speed has been very high in order to provide enough torsional force on the thread portion in the drawoff tube to permit transmission of torsional force past the bearing point of the thread on the tube mouth to the free thread end for binding the fibers on the fiber-collection surface onto the free thread end. Such transmission is necessary in order to prevent the thread end from being pulled away from the fiber-collection surface, thereby creating a thread break. However, such high speed creates an undesirably hard or tight twist in the thread.

3. Prior Art

As disclosed in DT-PS 1.560.305, the prior art teaches that the bearing force of the thread against the mouth of the drawoff tube can be intermittently relieved by the use of complicated vibrational drive mechanism. Another alternative for improving the torsional transfer to the thread end is disclosed in DT-OS 1.560.302 and U.S. Pat. No. 3,805,505, which suggest that the torsional force applied by the spinning rotor can be more effectively transmitted to the thread-binding point on the fiber-collection surface by roughening the mouth of the drawoff tube with notches or ribs.

Suitable vibration mechanism is very expensive, and the roughened tube mouths abrade and roughen the surface of the thread.

SUMMARY OF THE INVENTION

It is the principal object of the present invention to provide a simple, inexpensive device for effectively improving the transfer of torsional force to the thread-binding point on the fiber-collection surface while avoiding abrasive or other negative effects on the thread.

The foregoing object is accomplished by providing a deflecting element in the drawoff tube bore spaced axially of the bore from the infeed end of the tube. In the preferred embodiment, the deflecting element is a wire extending parallel to, but mounted eccentrically of the bore axis. Such wire may be soldered to the wall of the bore and, preferably, is fastened only at the wire end adjacent to the infeed end or mouth of the drawoff tube. The wire may be formed with an offset between its ends so that the unbonded wire portion is spaced radially inward from the tube wall a distance less than the bore radius.

As the thread travels circumferentially around the bore wall, it periodically engages the deflecting element which abruptly deflects the thread further away from the tube wall and then abruptly releases the thread, thereby plucking the tensioned thread and creating oscillations in it. The oscillatory movement of the thread relieves the force with which the thread bears against the tube mouth so that the torsional force in the thread portion extending through the tube bore is transmitted to the free thread end for effectively binding the fiber band on the collection surface to the thread end.

DETAILED DESCRIPTION

Figure 1:
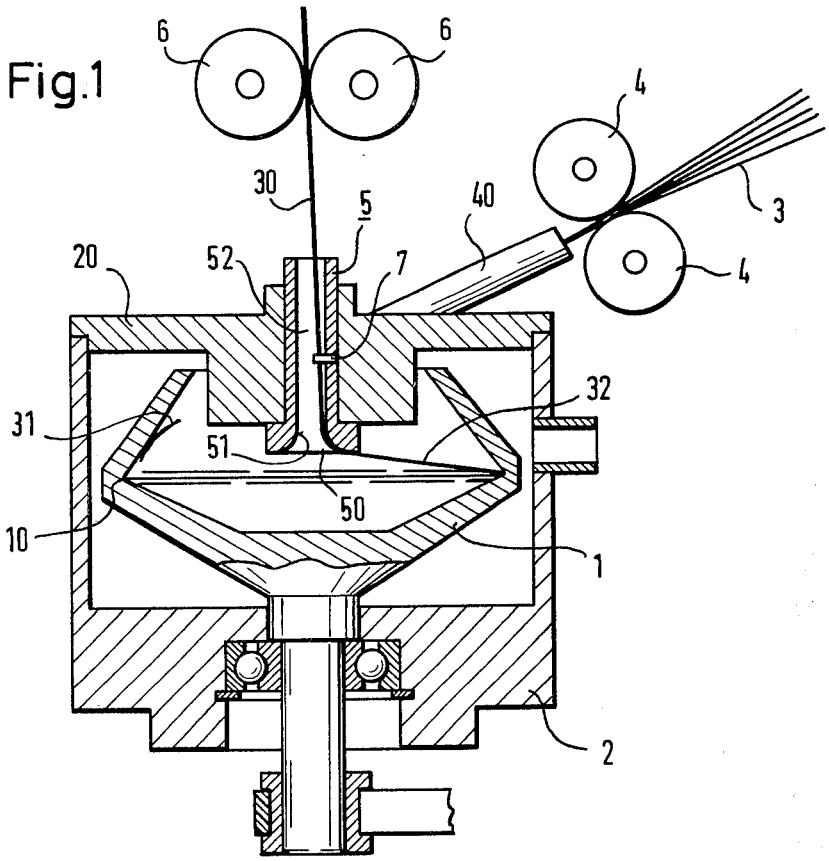
FIG. 1 is an axial section through a spinning rotor and drawoff tube according to the present invention.

The present invention is shown in a typical open-end spinning device having a spinning rotor 1 mounted in a housing 2 enclosed by a cover 20. The fiber material is conventionally supplied as a sliver 3 to a fiber supply and resolving device, which is shown schematically in FIG. 1 as a pair of supply rollers 4 and a supply tube 40. Fibers 31 supplied to the annular collection surface 10 of the spinning rotor is spun onto the end 32 of a thread 30. The thread is drawn off through a tube 5 by drawoff rollers 6. Tube 5 is disposed coaxially with the rotor 1 and has a mouth 50 at its infeed end leading to a cylindrical axial bore 52. The mouth 50 includes a curve 51 about which thread 30, 32 bends.

Thread 30 is held by the nip of drawoff roller 6 so that the thread cannot rotate about its axis. The free thread end 32, which extends from the mouth 50 of the drawoff tube 5 to the fiber-collection surface 10, is turned by centrifugal force created by the rotation of spinning rotor 1 and acts as a crank which creates twist in the stretch of thread 30 extending between drawoff rollers 6 and mouth 50 of the drawoff tube. It is important that this twisting or torsional force be transmitted to the thread portion 32 to bind in the fibers received by it at the fiber-collection surface 10. However, because the thread is bent as it enters the mouth 50 of the drawoff tube, the thread bears firmly against curve 51 of mouth 50 and substantially deters the effective transmittal of twist to the thread end portion 32. Thus it has been necessary to use a very high spinning speed to create sufficient torsional force in the thread stretch in the drawoff tube to overcome the friction at curve 51 and to transmit rotation to thread portion 32. The result is to produce an excessively twisted thread. If the spinning speed and, therefore, the twisting force is reduced, thread end 32 tends to pull away from the fiber band on the collection surface 10, instead of binding the fiber band onto the thread end; therefore, frequent thread breaks result.

To prevent the effective barrier to twist transmission at mouth 50 and to facilitate substantially transmission of the rotational force from the thread portion between rollers 6 and curve 51 to the thread portion 32 from curve 51 to the collection surface 10, a deflecting element is provided in the bore 52 of drawoff tube 5, which deflecting element is spaced inwardly from curve 51. Such element can be constructed in various configurations and mounted in the tube in various ways. Furthermore, a plurality of deflecting elements could be provided and distributed circumferentially around the wall of bore 52. The abrasive effect characteristic of notches and ribs at the tube mouth does not occur with this construction both because the present invention permits reduced torsional force and because the thread angles away from the tube wall inwardly of the infeed end instead of bearing against the wall.

In the embodiment of the invention shown in FIG. 1, the deflecting element is a projection 7 in the form of a pin press-fit into a radial bore in the wall of drawoff tube 5. Alternatively, the projection could be formed as a sheet metal strip bent into a rounded profile and wedged into an axially extending slot in the wall of tube bore 52. In whatever form the deflecting element is provided, it is necessary that the element not project beyond mouth 50 of tube 5 to avoid the problem of abrasion and to prevent entanglement with the thread end portion 32.

Figure 2:
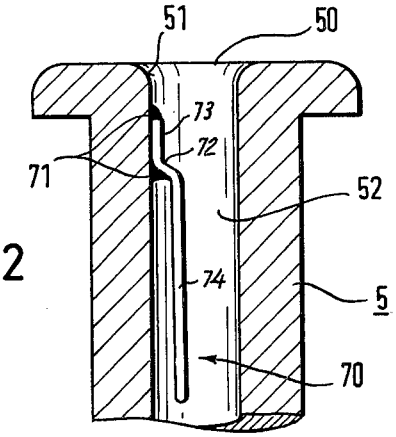
FIG. 2 is a fragmentary axial section through the portion of a drawoff tube including the infeed end showing a modified form of the invention.

In FIG. 2, in which the tube 5 is inverted from the position of FIG. 1, the preferred embodiment of the deflecting element is shown. The element is formed by an axially extending wire 70 mounted eccentrically in bore 52. While wire 70 may be fastened in various ways, it is advantageously soldered. Although the wire could be straight and soldered at its opposite ends, it is preferred that the wire be bent at 72 to form a portion 73 which lies along the bore wall and is soldered to the wall at location 71 and an offset portion 74 which extends parallel to but spaced from the tube wall a distance less than the radius of bore 52. It is preferred that wire 70 be disposed with the soldered portion 73 adjacent to the spinning rotor 1 and infeed mouth 50 of the drawoff tube 5. This construction provides satisfactory oscillation in the thread while reducing the abruptness of the plucking effort, thereby providing greater assurance that the thread will not be overly stressed nor snapped away from the fiber-collection surface.

As the bearing location of thread 30 on drawoff tube curve 51 is rotated circumferentially of mouth 50 by the rotation of the spinning rotor 1 operating on the thread end 32 at its binding point on the fiber-collection surface 10, the thread 30 periodically moves into engagement with projection 7 or wire 70 which plucks the thread from the wall of the bore 52. The tension in the thread causes it to spring back against the wall when it is released by the deflecting element 7 or 70. This plucking action causes the thread to oscillate, momentarily relieving the bearing force of the thread against curve 51, and thereby permitting nearly unhindered transmission of the torsional force from thread 30 along end portion 32 to its binding point with fiber-collection surface 10 of spinning rotor 1. This unhindered transmission of the torsional force produces a less tightly twisted thread while providing secure binding in of fibers 31 with the thread end 32 at the binding point on fiber-collection surface 10.

As discussed above, insufficient transmission of the torsional force to the thread end prevents the thread end from adequately binding up the fibers deposited on the fiber-collection surface. Consequently, the thread end loses centrifugal force contact with the band and a thread break results. Prior to the present invention, thread breaks were prevented by increasing the rotation of the thread portion in the drawoff tube bore to a value sufficient to transmit adequate twist at the thread end, resulting in the spun thread having an overly twisted character. The use of grooves and ribs at the mouth of the drawoff tube previously used to produce an oscillatory effect caused abrasion on the thread because of the high centripetal force on the thread at the curve around the drawoff tube mouth. Because the deflecting element of the present invention is spaced from the mouth of the drawoff tube, the mouth rim can be smooth; and the thread is oscillated in a simple manner by being periodically plucked.

We claim:

1. In an open-end spinning machine, a spinning rotor having an annular fiber-collection surface, a thread drawoff tube having a bore therethrough disposed with its axis substantially perpendicular to a plane of the fiber-collection surface, and thread drawoff means for drawing off thread formed in the spinning rotor through the drawoff tube bore and thereby bending the thread around the drawoff tube infeed mouth, the improvement comprises plucking means in the drawoff tube bore at a location spaced from the drawoff tube infeed mouth for periodically plucking the thread portion extending through the tube bore, and mounting means for mounting said plucking means in the drawoff tube bore.

2. In an open-end spinning machine, a spinning rotor having an annular fiber-collection surface, a thread drawoff tube having a bore therethrough disposed with its axis substantially perpendicular to a plane of the fiber-collection surface, and thread drawoff means for drawing off thread formed in the spinning rotor through the drawoff tube bore and thereby bending the thread around the drawoff tube infeed mouth, the improvement comprises wire means in the drawoff tube bore at a location spaced drom the drawoff tube infeed mouth and disposed parallel to, but eccentrically of the drawoff tube bore axis for periodically plucking the thread portion extending through the tube bore, and mounting means for mounting said wire in the drawoff tube bore.

3. In the open-end spinning machine defined in claim 2, the mounting means including a soldered connection between the wire and the wall of the drawoff tube bore.

4. In the spinning machine defined in claim 2, the wire having a first portion spaced radially inward from the drawoff tube bore wall and a second portion offset from said first portion and disposed at the end of said first portion adjacent to the drawoff tube infeed mouth, said second portion being connected with the mounting means.

* * * * *